US010475384B2

(12) United States Patent
Kang

(10) Patent No.: US 10,475,384 B2
(45) Date of Patent: Nov. 12, 2019

(54) DISPLAY DEVICE COMPRISING A LIGHTING PART

(71) Applicant: LG Display Co., Ltd., Seoul (KR)

(72) Inventor: Byungkoo Kang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/658,738

(22) Filed: Jul. 25, 2017

(65) Prior Publication Data

US 2018/0033375 A1 Feb. 1, 2018

(30) Foreign Application Priority Data

Jul. 29, 2016 (KR) ..... 10-2016-0097495

(51) Int. Cl.
*G09G 3/3258* (2016.01)
*G09G 3/14* (2006.01)
*G09G 3/3233* (2016.01)

(52) U.S. Cl.
CPC ..... *G09G 3/3258* (2013.01); *G09G 3/14* (2013.01); *G09G 3/3233* (2013.01); *G09G 2300/0408* (2013.01); *G09G 2300/0426* (2013.01); *G09G 2300/0452* (2013.01); *G09G 2300/0814* (2013.01); *G09G 2330/027* (2013.01); *G09G 2330/028* (2013.01); *G09G 2354/00* (2013.01)

(58) Field of Classification Search
CPC ..... G09G 3/3258; G09G 2/3233; G09G 3/14
See application file for complete search history.

(56) References Cited

U.S. PATENT DOCUMENTS

2011/0279483 A1* 11/2011 Ek ..... G06F 1/16 345/690
2013/0278158 A1 10/2013 Kim
2014/0183481 A1* 7/2014 Lee ..... H01L 27/3213 257/40
2014/0347401 A1* 11/2014 Hwang ..... G09G 3/3233 345/690
2016/0020261 A1 1/2016 Kim
2016/0104409 A1* 4/2016 Jeon ..... G09G 3/3225 345/690

FOREIGN PATENT DOCUMENTS

KR 10-1023456 B1 3/2011

* cited by examiner

*Primary Examiner* — Kwang-Su Yang
(74) *Attorney, Agent, or Firm* — Morgan, Lewis & Bockius LLP

(57) ABSTRACT

A display device includes a display panel having a data display area in which pixels are arranged and a lighting part outside the data display area; a display panel driver driving an organic light-emitting diodes in the pixels; and a lighting driver driving an organic light-emitting diodes in the lighting part; and a power supply part generating the high-potential power supply voltage and the low-potential power supply voltage, wherein the lighting part includes: one or more second high-potential power supply lines connected between the power supply part and the organic light-emitting diodes in the lighting part; and a switch connected to the second high-potential power supply lines, and wherein the lighting driver turns on the switch to supply the high-potential power supply voltage to the organic light-emitting diodes in the lighting part when there is an user input or a system power is turned off.

11 Claims, 7 Drawing Sheets

DISPLAY DEVICE COMPRISING A LIGHTING PART

This application claims the priority benefit of Korean Patent Application No. 10-2016-0097495 filed on Jul. 29, 2016, which is hereby incorporated herein by reference for all purposes as if fully set forth herein.

BACKGROUND

Technical Field

The present invention relates to a display device having a lighting part.

Discussion of the Related Art

An organic light-emitting diode display is a self-luminous device; thus, it has lower power consumption and can be made thinner than a liquid crystal display which requires backlighting. Moreover, the organic light-emitting diode display has wide viewing angle and fast response time. As the processing techniques have evolved to such a level that enables mass production of large-area devices, organic light-emitting diode displays are expanding the market while competing with liquid crystal displays.

The pixels of an organic light-emitting diode display include organic light-emitting diodes (hereinafter, "OLEDs"), which are self-emissive. An OLED is composed of a stack of organic layers, including a hole injection layer HIL, a hole transport layer HTL, an emission layer EML, an electron transport layer ETL, and an electron injection layer EIL, which are situated between an anode and a cathode. The OLED display reproduces input images based on a phenomenon in which electrons and holes recombine in the organic layers in the OLED of each pixel to emit light as current flows through a fluorescent or phosphorescent organic thin film.

The OLED display can be classified into many types, depending on the type of emissive material, the emission method, the emission structure, and the driving method. The OLED display can be classified as a fluorescent emission device or a phosphorescent emission device depending on the emission method, or classified as a top emission device or a bottom emission device depending on the emission structure. Also, the OLED display can be classified as a PMOLED (Passive Matrix OLED) display or an AMOLED (Active Matrix OLED) display depending on the driving method.

A display device may further include a variety of structures such as lighting, sensors, etc. for complementing and improving the primary functions. However, additional manufacturing or assembling processes are required in order to provide such structures, which leads to increased processing time and costs and makes it difficult to make room for these structures due to limited space.

SUMMARY

Accordingly, embodiments of the present disclosure are directed to a display device that substantially obviates one or more of the problems due to limitations and disadvantages of the related art.

An aspect of the present invention is to provide a display device having a lighting part.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises a display panel having a data display area in which pixels are arranged and a lighting part outside the data display area; a display panel driver driving organic light-emitting diodes in the pixels; and a lighting driver driving the organic light-emitting diodes in the lighting part; and a power supply part generating the high-potential power supply voltage and the low-potential power supply voltage, wherein the lighting part comprises: one or more second high-potential power supply lines connected between the power supply part and the organic light-emitting diodes in the lighting part; and a switch connected to the second high-potential power supply lines, and wherein the lighting driver turns on the switch to supply the high-potential power supply voltage to the organic light-emitting diodes in the lighting part when there is an user input or a system power is turned off.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Reference will now be made in detail to embodiments illustrated in the accompanying drawings, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention. In describing several embodiments, the same components will be representatively described at the beginning and may be omitted in other embodiments.

It will be understood that, although the terms first, second, etc. may be used herein to describe various elements, these elements should not be limited by these terms. These terms are only used to distinguish one element from another.

Figure 1:
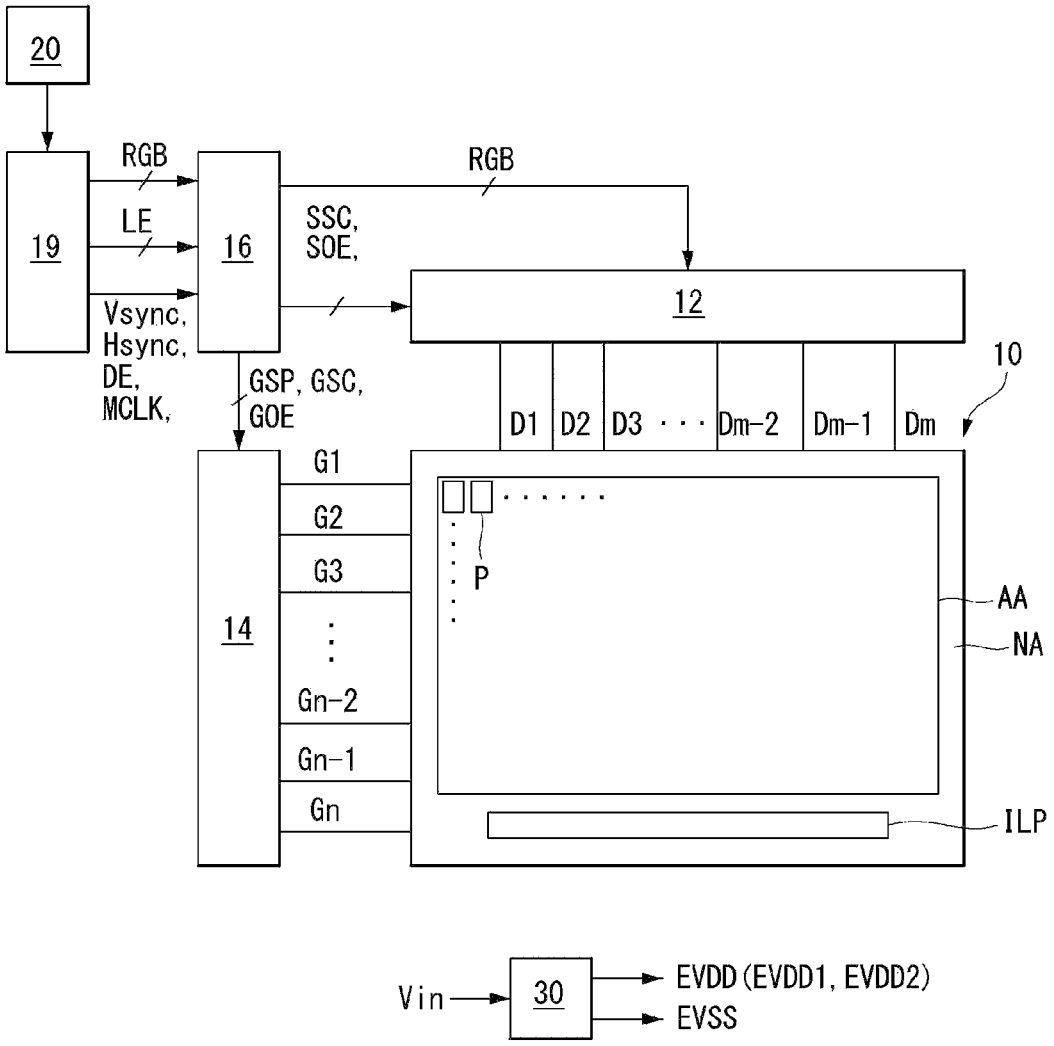
FIG. 1 is a schematic diagram of a display device according to the present invention.
Figure 2:
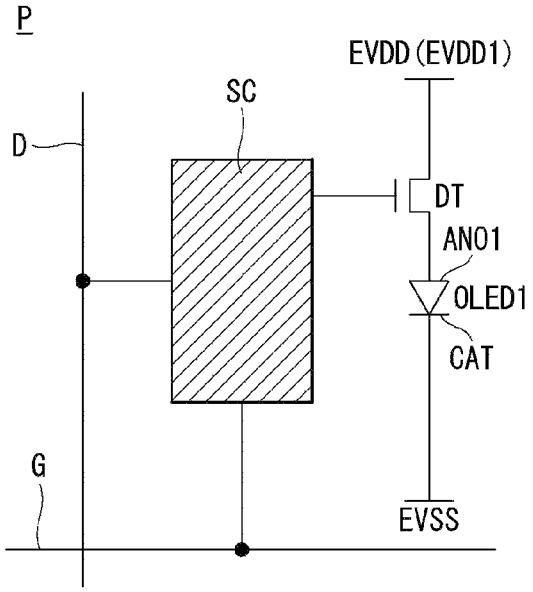
FIG. 2 is a circuit diagram showing a pixel in a data display area.
Figure 3:
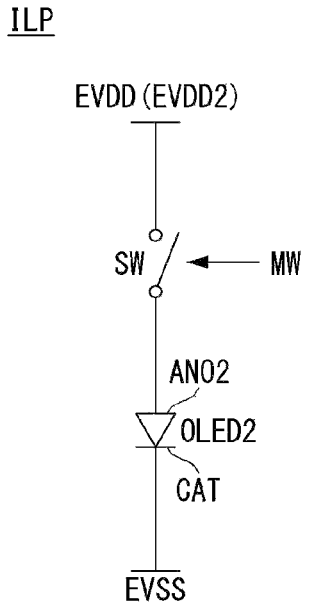
FIG. 3 is a circuit diagram showing a lighting part in a data non-display area.

FIG. 1 is a schematic diagram of a display device according to the present invention. FIG. 2 is a circuit diagram showing a pixel in a data display area. FIG. 3 is a circuit diagram showing a lighting part in a data non-display area.

Referring to FIG. 1, an organic light-emitting diode display according to the present invention comprises a display panel driver and a display panel 10.

The display panel driver comprises a data drive circuit 12, a gate drive circuit 14, and a timing controller 16, and writes a video data voltage for an input image to the pixels on the display panel 10. The data drive circuit 12 converts digital video data RGB input from the timing controller 16 to an analog gamma compensation voltage to generate a data voltage. The data voltage output from the data drive circuit 12 is supplied to data lines D1 to Dm. The gate drive circuit 14 sequentially supplies a gate pulse synchronous with the data voltage to gate lines G1 to Gn to select pixels on the display panel 10 to which the data voltage is written.

The timing controller 16 receives timing signals, such as a vertical synchronization signal Vsync, a horizontal synchronization signal Hsync, a data enable signal DE, and a main clock MCLK, from a host system 19 to synchronize the operation timings of the data drive circuit 12 and gate drive circuit 14 with each other. Data timing control signals for controlling the data drive circuit 12 comprise a source sampling clock SSC, a source output enable signal SOE, etc. Gate timing control signals for controlling the gate drive circuit 14 comprise a gate start pulse GSP, a gate shift clock GSC, a gate output enable signal GOE, etc.

The host system 19 may be implemented as one among a television system, a set-top box, a navigation system, a DVD player, a Blu-ray player, a personal computer (PC), a home theater system, and a phone system. The host system 19 comprises a system-on-chip (SoC) with a scaler embedded in it, and converts the digital video data RGB for the input image into a data format suitable for display on the display panel 10. The host system 19 transmits the timing signals Vsync, Hsync, DE, and MCLK to the timing controller 16, along with the digital video data RGB for the input image received from a video source.

The host system 19 may control the system functions in response to user input received through a user interface 20. In an example, the host system 19 may generate a lighting enable signal LE in response to user input in order to drive the lighting part ILP. That is, upon receiving a lighting drive command from the user, the host system 19 generates a lighting enable signal LE and transmits it to the timing controller 16. In response to the lighting enable signal LE received from the host system 19, the timing controller 16 generates a switch control signal MW (see FIG. 3) for switching on the lighting part ILP.

When the system power is turned on by the user, the host system 19 generates a power-on signal EI_ON, and at the same time, generates an input voltage Vin for a power supply part 30 to drive the power supply part 30 and the display panel driver 12, 14, and 16. Upon receiving the power-on signal EL_ON, the display panel driver 12, 14, and 16 is driven to write input image data to the pixels P on the display panel 10, thereby reproducing an input image on the display panel 10.

As another example for driving the lighting part ILP, when the system power is turned off, the host system 19 may generate an input voltage Vin for the power supply part 30 and generate a lighting enable signal LE, in order to switch on the lighting part ILP on the display panel 10.

Generally, when the system power is turned off, the driving power of the host system 19 and display panel driver 12, 14, and 16 is turned off, thus causing all circuits in the system to stop operating. In the present invention, when the system power is turned off, the power supply part 30 is driven to supply a high-potential power supply voltage EVDD and a low-potential power supply voltage EVSS, which are generated from the power supply part 30, to the organic light-emitting diodes in the lighting part ILP, and the timing controller 16 is driven to generate a switch control signal MW (see FIG. 3) for switching on the lighting part ILP. Accordingly, in the present invention, the lighting part ILP may be switched on, even in a period when the system power is turned off and therefore the pixels P are not driven.

As described above, in the present invention, the lighting part ILP on the display panel 10 may be switched on in a period when a lighting drive command is received from the user or when the system power is turned off and therefore the pixels P are not driven. The present invention may provide a display device with greater convenience of use since the lighting part ILP can be controlled in response to a preset event.

The lighting part ILP is controlled by a lighting driver. The lighting driver may be implemented as a lighting control logic circuit in the host system 19 and as a lighting control logic circuit in the timing controller 16. That is, the host system 19 may serve as the lighting driver while controlling the entire system circuits, and the timing controller 16 may serve as the lighting driver while controlling the operation timing of the display panel driver.

The user interface 20 transmits user input data to the host system 19. The user interface 20 may comprise a mechanical input means and a touch-type input means. However, the present invention is not limited to them. As an example, the touch-type input means may be configured with virtual keys displayed on a touchscreen through software processing, soft keys, visual key, or touch keys disposed on a portion other than the touchscreen. In addition, the virtual keys or visual keys may be displayed on the touchscreen in various forms, and, for example, may be configured with graphics, text, icons, video, or a combination thereof.

The power supply part 30 is mounted on a PCB (printed circuit board). When an input voltage Vin is supplied from the host system 19, the power supply part 30 generates a high-potential power supply voltage EVDD and a low-potential power supply voltage EVSS. The power supply part 30 generates a driving voltage required for driving the display panel driver 12, 14, and 16 and the display panel 10 by using a DC-DC converter, a charge pump, a regulator, etc. The power supply part 30 outputs a power supply voltage Vcc for the display panel driver 12, 14, and 16, a gate-high voltage VGH and gate-low voltage VGL for gate pulses, a gamma reference voltage, a high-potential power supply voltage EVDD, a low-potential power supply voltage EVSS, etc.

The display panel 10 comprises a data display area AA in which an input image is displayed and a data non-display area NA outside the data display area AA. The data display area AA comprises a pixel array. The pixel array on the display panel 10 comprises pixels P defined by data lines D1 to Dm (m is a positive integer) and gate lines G1 to Gn (n is a positive integer). Each pixel P comprises a first organic light-emitting diode (hereinafter, "OLED") OLED1, which is self-emissive. The data non-display area NA comprises at least one second OLED OLED2. The second OLED OLED2 is connected to at least one switch SW to constitute the lighting part ILP.

Referring further to FIG. 2, the pixel array in the data display area AA comprises pixels P arranged in a matrix. The pixels P may be defined by the intersections of a plurality of data lines D and a plurality of gate lines G. Each pixel P comprises a first OLED OLED1, a driving thin-film transistor (hereinafter, "TFT") DT for controlling the amount of current flowing through the first OLED OLED1, and a programming part SC for setting the gate-source voltage of the driving TFT DT.

The programming part SC may comprise at least one switching (SW) TFT and at least one storage capacitor. The switching (SW) TFT turns on in response to a gate pulse from a gate line G to thereby apply a data voltage from a data line D to one electrode of the storage capacitor. The driving TFT DT adjusts the amount of light emitted by the first OLED OLED1 by controlling the amount of current supplied to the first OLED OLED1 depending on the amount of voltage stored in the storage capacitor. The amount of light emitted by the first OLED OLED1 is proportional to the amount of current supplied from the driving TFT DT.

The TFTs of the pixel P may be implemented as p-type or n-type. Also, a semiconductor layer for the TFTs of the pixel P may comprise amorphous silicon, or polysilicon, or oxide. The first OLED OLED1 comprises a first anode ANO1, a cathode CAT, and an organic compound layer interposed between the first anode ANO1 and the cathode CAT. The first anode ANO1 is connected to the driving TFT DT. The organic compound layer comprises an emission layer EML, and may further comprise one or more of the following: a hole injection layer HIL, a hole transport layer HTL, an electron transport layer ETL, and an electron injection layer EIL. The pixel P receives the high-potential power supply voltage EVDD and low-potential power supply voltage EVSS which are generated by the power supply part 30. The high-potential power supply voltage EVDD is applied to the drain electrode of the driving TFT DT. The low-potential power supply voltage EVSS is applied to the cathode CAT.

The data non-display area NA comprises at least one second OLED OLED2. As shown in FIG. 3, the second OLED OLED2 is connected to the switch SW for switching on and off the second OLED OLED2 and constitutes the lighting part ILP. The second OLED OLED2 comprises a second anode ANO2, a cathode CAT, and an organic compound layer interposed between the second anode ANO2 and the cathode CAT. The second anode ANO2 receives the high-potential power supply voltage EVDD from the power supply part 30 through the switch SW. The cathode CAT receives the low-potential power supply voltage EVSS from the power supply part 30.

The switch SW switches on and off the current path between the second anode ANO2 and the power supply part 30 in response to a switch control signal MW. The switch SW may connect the power supply part 30 to the second anode ANO2 or make them floating. Floating means disconnecting the current path between the second anode ANO2 and the power supply part 30.

First Exemplary Embodiment

Figure 4:
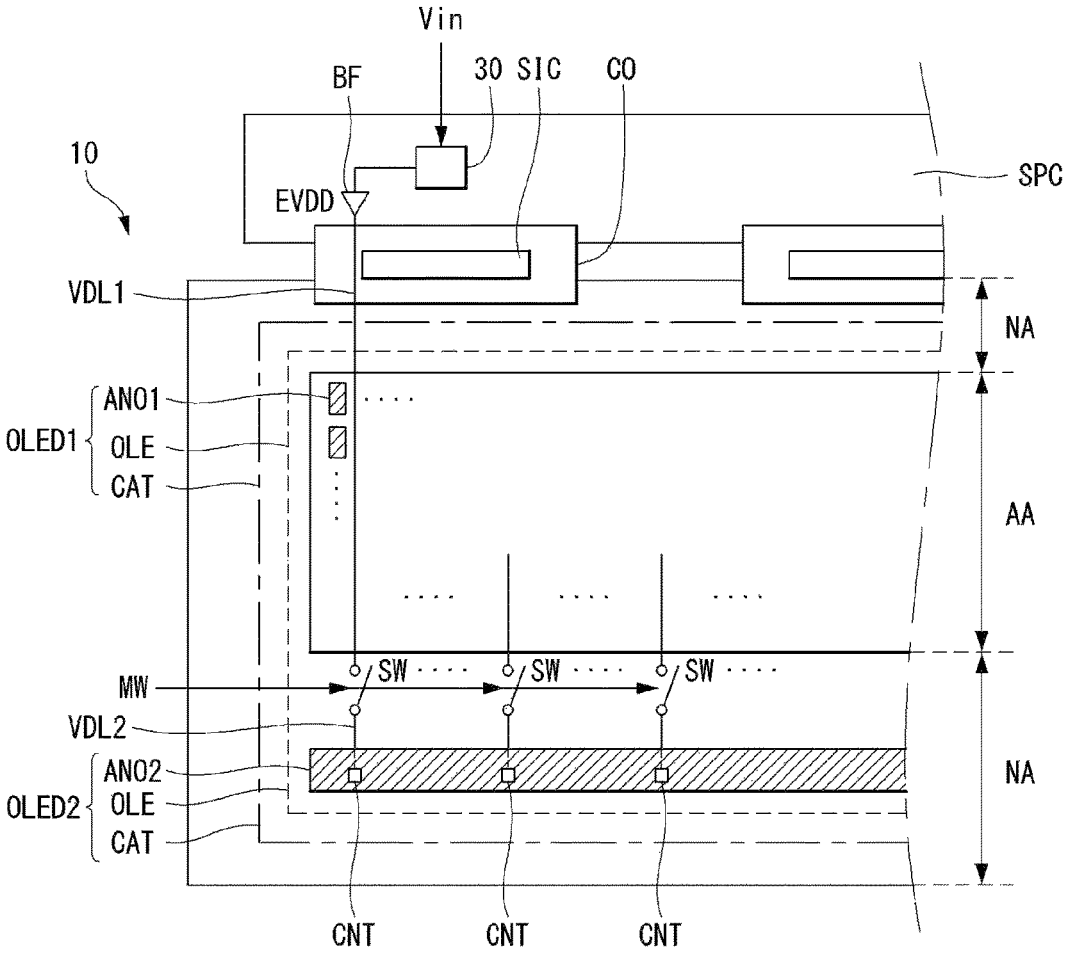
FIG. 4 is a schematic diagram of a display device according to a first exemplary embodiment of the present invention.

Hereinafter, a display device according to a first exemplary embodiment of the present invention will be described with reference to FIG. 4. FIG. 4 is a schematic diagram of the display device according to the first exemplary embodiment of the present invention.

Referring to FIG. 4, the display device according to the first exemplary embodiment of the present invention comprises a display panel driver, a display panel 10, and a lighting part ILP.

The display panel driver writes input image data to the display panel 10. The display panel driver comprises a source drive IC SIC and a source PCB (printed circuit board) SPC. The source drive IC SIC may be mounted on a bendable, flexible circuit substrate, for example, a COF (chip-on-film) CO. In the case of large-screen displays, the source PCB SPC may be divided into multiple parts. Opposite ends of the COF CO may be bonded to the display panel 10 and the source PCB SPC, respectively, through an ACF (anisotropic conductive film).

The power supply part 30 is mounted on the source PCB SPC. As described above, the power supply part 30 is driven by an input voltage Vin from the host system 19 and generates a voltage required for driving the display panel driver 12, 14, and 19 and the display panel 10.

The display panel 10 comprises a data display area AA in which an input image is displayed and a data non-display area NA outside the data display area AA. The data display area AA comprises pixels arranged in a matrix. Each pixel is divided into a red subpixel, a green subpixel, and a blue subpixel to produce colors. Each pixel may further comprise a white subpixel.

Each pixel comprises a first OLED OLED1 and a TFT for driving the first OLED OLED1. The first OLED OLED1 comprises a first anode ANO1, an organic compound layer OLE, and a cathode CAT.

The first anode ANO1 is segmented to correspond to each pixel and connected to the drain electrode of the driving TFT in each pixel. The source electrode of the driving TFT is connected to the power supply part 30 through a first high-potential power supply line VDL1 and receives the high-potential power supply voltage EVDD.

The power supply part 30 comprises an output terminal outputting the high-potential power supply voltage EVDD. The first high-potential power supply line VDL1 is connected to the output terminal of the power supply part 30 through a buffer BF, and transmits the high-potential power supply voltage EVDD to the driving TFT of each pixel. The first high-potential power supply line VDL1 runs across the data display area AA on the display panel 10 and is connected to the pixels.

The organic compound layer OLE may comprise a white pigment and be applied over the entire surface of the substrate. The white pigment may be applied over a wide area, from the data display area AA to the data non-display area NA. In this case, the red, green, and blue subpixels may comprise the corresponding red, green, and blue color filters, respectively. Alternatively, the organic compound layer OLE may comprise red, green, and blue pigments which are separately applied to the corresponding red, green, and blue subpixels.

The cathode CAT is formed over a wide area, from the data display area AA to part of the data non-display area NA. The cathode CAT is connected to the power supply part 30 through a low-potential power supply line and receives the low-potential power supply voltage EVSS.

The lighting part ILP comprises a second OLED OLED2 provided in the data non-display area NA and a switch SW for controlling the second OLED OLED2. The second OLED OLED2 comprises a second anode ANO2, an organic compound layer OLE, and a cathode CAT.

The second anode ANO2 is electrically connected to the power supply part 30 through at least one second high-potential power supply line VDL2 and receives the high-potential power supply voltage EVDD. The second anode ANO2 may be connected to the second high-potential power supply line VDL2 through one or more contact holes CNT penetrating at least one insulating film that is disposed between the second anode ANO2 and the second high-potential power supply line VDL2. The second anode ANO2 may be preferably connected to a plurality of second high-potential power supply lines VDL2.

The first high-potential power supply line VDL1 may be connected to the second high-potential power supply line VDL2 through the switch SW. One end of the high-potential power supply line VDL1 is connected to the output terminal of the power supply part 30, and the other end is connected to the switch SW. One end of the second high-potential power supply line VDL2 is connected to the switch SW, and the other end is connected to the second anode ANO2.

The switch SW may connect the first high-potential power supply line VDL1 and the second high-potential power supply line VDL2 or make them floating, in response to a switch control signal MW from the timing controller 16. When the switch SW is turned on, the second anode ANO2 receives the high-potential power supply voltage EVDD from the power supply part 30 via a power supply path comprising the first high-potential power supply line VDL1 and the second high-potential power supply line VDL2. In this case, the second OLED OLED2 maintains the on state. When the switch SW is turned off, the second anode ANO2 goes to a floating state and therefore cannot receive the high-potential power supply voltage EVDD. In this case, the second OLED OLED2 maintains the off state.

If the organic compound layer OLE comprises a white pigment, the white pigment may be applied to cover the pixels in the data display area AA and the second anode ANO2 in the data non-display area NA. Alternatively, if the organic compound layer OLE comprises red, green, and blue pigments, at least one of these pigments may be locally applied so as to have an island pattern on the second anode ANO2. However, the present invention is not limited to this.

The cathode CAT is formed over a wide area, from the data display area AA to part of the data non-display area NA. The cathode CAT is shared by the pixels in the data display area AA and lighting part ILP on the display panel 10. In other words, the pixels in the data display area AA and lighting part ILP share the cathode CAT. The cathode CAT is connected to the power supply part 30 through a low-potential power supply line and receives the low-potential power supply voltage EVSS.

The display device according to the present invention may improve space utilization by forming the lighting part ILP in an empty space outside the data display area AA where an input image is reproduced.

In the display device according to the present invention, organic light-emitting diodes OLED1 may be formed in the pixels in the data display area AA, and at the same time, a lighting part ILP having organic light-emitting diodes OLED2 may be formed in the data non-display area NA. Accordingly, the display device according to the present invention can save manufacturing time and costs incurred by an additional process and reduce the rate of defects resulting from the additional process, since there is no need to form a lighting part by an additional process.

Second Exemplary Embodiment

Figure 5:
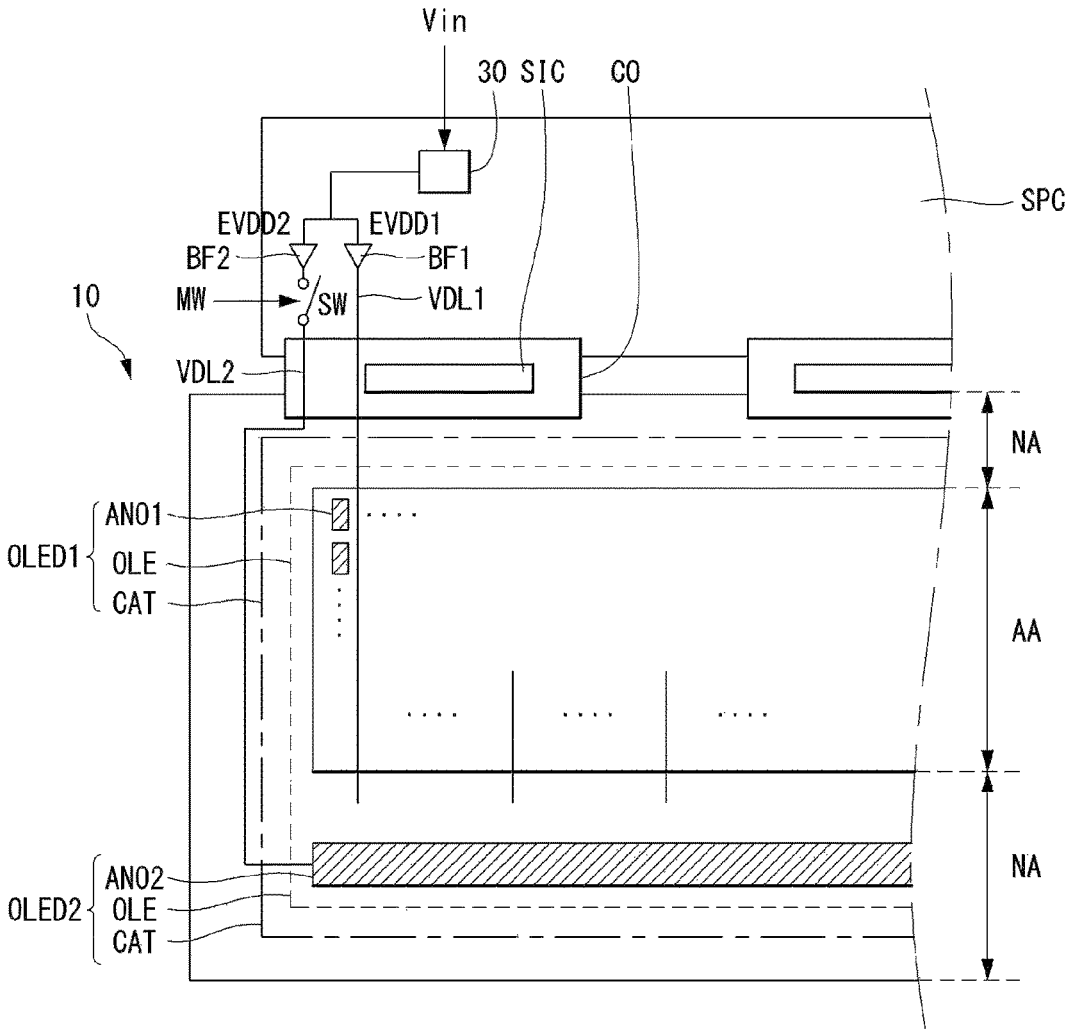
FIG. 5 is a schematic diagram of the display device according to a second exemplary embodiment of the present invention.

Hereinafter, a display device according to a second exemplary embodiment of the present invention will be described with reference to FIG. 5. FIG. 5 is a schematic diagram of the display device according to the second exemplary embodiment of the present invention.

Referring to FIG. 5, the display device according to the second exemplary embodiment of the present invention comprises a display panel driver, a display panel 10, and a lighting part ILP.

The display panel driver writes input image data to the display panel 10. The display panel driver comprises a source drive IC SIC and a source PCB SPC. The source drive IC SIC may be mounted on a bendable, flexible circuit substrate, for example, a COF CO. In the case of large-screen displays, the source PCB SPC may be divided into multiple parts. Opposite ends of the COF CO may be bonded to the display panel 10 and the source PCB SPC, respectively, through an ACF.

The power supply part 30 is mounted on the source PCB SPC. As described above, the power supply part 30 is driven by an input voltage Vin from the host system 19 and generates a voltage required for driving the display panel driver 12, 14, and 19 and the display panel 10.

The display panel 10 comprises a data display area AA in which an input image is displayed and a data non-display area NA outside the data display area AA. The data display area AA comprises pixels arranged in a matrix. Each pixel is divided into a red subpixel, a green subpixel, and a blue subpixel to produce colors. Each pixel may further comprise a white subpixel.

Each pixel comprises a first OLED OLED1 and a TFT for driving the first OLED OLED1. The first OLED OLED1 comprises a first anode ANO1, an organic compound layer OLE, and a cathode CAT.

The first anode ANO1 is segmented to correspond to each pixel and connected to the drain electrode of the driving TFT in each pixel. The source electrode of the driving TFT is connected to the power supply part 30 through a first high-potential power supply line VDL1 and receives the first high-potential power supply voltage EVDD1.

The power supply part 30 comprises an output terminal outputting a high-potential power supply voltage EVDD1 and EVDD2. The first high-potential power supply voltage EVDD1 and The second high-potential power supply voltage EVDD2 may be the same voltage, but are not limited thereto. The first high-potential power supply line VDL1 is connected to the output terminal of the power supply part 30 through a first buffer BF1, and transmits the first high-potential power supply voltage EVDD1 to the driving TFT of each pixel. The first high-potential power supply line VDL1 runs across the data display area AA on the display panel 10 and is connected to the pixels.

The organic compound layer OLE may comprise a white pigment and be applied over the entire surface of the substrate. The white pigment may be applied over a wide area, from the data display area AA to the data non-display area NA. In this case, the red, green, and blue subpixels may comprise the corresponding red, green, and blue color filters, respectively. Alternatively, the organic compound layer OLE may comprise red, green, and blue pigments which are separately applied to the corresponding red, green, and blue subpixels.

The cathode CAT is formed over a wide area, from the data display area AA to part of the data non-display area NA. The cathode CAT is connected to the power supply part 30 through a low-potential power supply line and receives the low-potential power supply voltage EVSS.

The lighting part ILP comprises a second OLED OLED2 provided in the data non-display area NA and a switch SW for controlling the second OLED OLED2. The second OLED OLED2 comprises a second anode ANO2, an organic compound layer OLE, and a cathode CAT.

The second anode ANO2 is electrically connected to the power supply part 30 through at least one second high-potential power supply line VDL2 and receives the second high-potential power supply voltage EVDD2. The second high-potential power supply line VDL2 is connected to the second anode ANO2 by bypassing the data display area AA on the display panel 10.

The power supply part 30 comprises an output terminal outputting the high-potential power supply voltage EVDD1 and EVDD2. The second high-potential power supply line VDL2 is connected to the output terminal of the power supply part 30 through a second buffer BF2, and transmits the second high-potential power supply voltage EVDD2 to the anode ANO2. The second anode ANO2 may be preferably connected to a plurality of second high-potential power supply lines VDL2.

The first high-potential power supply line VDL1 and the second high-potential power supply line VDL2 are separated from each other. The first high-potential power supply line VDL1 and the second high-potential power supply line VDL2 are connected to the different output terminals of the power supply part 30 through the different buffers BF1 and BF2, and receive the first and second high-potential power supply voltage EVDD1 and EVDD2, respectively, via different power supply paths.

The switch SW is connected to the second high-potential power supply line VDL2. The switch SW may connect the power supply part 30 and the second anode ANO2 or make them floating, in response to a switch control signal MW. When the switch SW is turned on, the second anode ANO2 receives the second high-potential power supply voltage EVDD2 from the power supply part 30 via the second high-potential power supply line VDL2. In this case, the second OLED OLED2 maintains the on state. When the switch SW is turned off, the second anode ANO2 goes to a floating state and therefore cannot receive the second high-potential power supply voltage EVDD2. In this case, the second OLED OLED2 maintains the off state.

The switch SW may be disposed on the display panel driver or the display panel 10. As long as the switch SW can electrically connect the power supply part 30 and the second anode ANO2 through the second buffer BF2, the position of the switch SW is not restricted. For example, the switch SW may be provided on the source PCB or COF, or may be provided in the data non-display area NA of the display panel 10.

If the organic compound layer OLE comprises a white pigment, the white pigment may be applied to cover the pixels in the data display area AA and the second anode ANO2 in the data non-display area NA. Alternatively, if the organic compound layer OLE comprises red, green, and blue pigments, at least one of these pigments may be locally applied so as to have an island pattern on the second anode ANO2. However, the present invention is not limited to this.

The cathode CAT is formed over a wide area, from the data display area AA to part of the data non-display area NA. The cathode CAT is shared by the pixels in the data display area AA of the display panel 10 and the lighting part ILP. In other words, the pixels in the data display area AA and lighting part ILP share the cathode CAT. The cathode CAT is connected to the power supply part 30 through a low-potential power supply line and receives the low-potential power supply voltage EVSS.

The display device according to the present invention may improve space utilization by forming the lighting part ILP in an empty space outside the data display area AA where an input image is reproduced.

In the display device according to the present invention, organic light-emitting diodes OLED1 may be formed in the pixels in the data display area AA, and at the same time, a lighting part ILP having organic light-emitting diodes OLED2 may be formed in the data non-display area NA. Accordingly, the display device according to the present invention can save manufacturing time and costs incurred by an additional process and reduce the rate of defects resulting from the additional process, since there is no need to form a lighting part by an additional process.

Third Exemplary Embodiment

Figure 6:
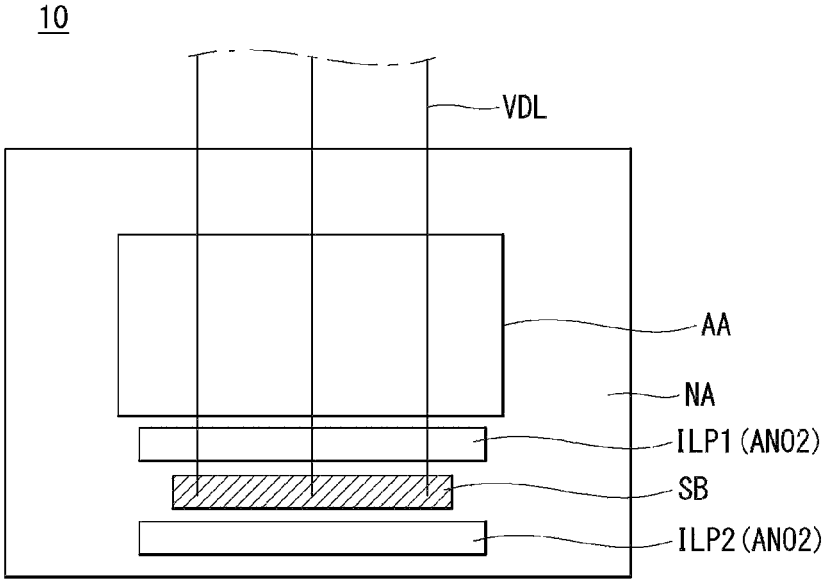
FIGS. 6 and 7 are explanatory diagrams of the position and shape of a lighting part.
Figure 7:
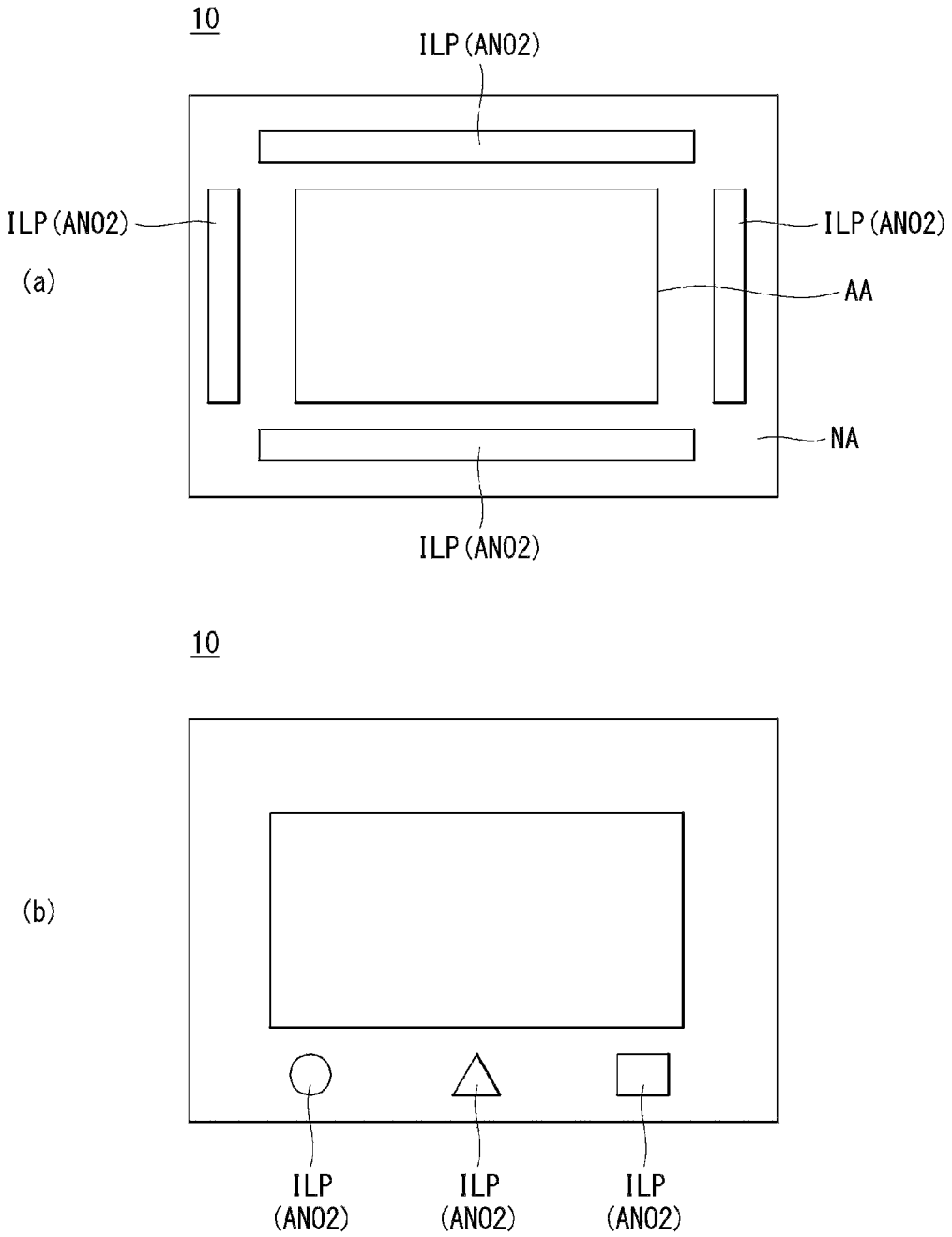

Hereinafter, an exemplary embodiment related to the position and shape of the lighting part ILP according to the present invention will be described with reference to FIGS. 6 and 7. FIGS. 6 and 7 are explanatory diagrams of the position and shape of a lighting part.

Referring to FIG. 6, the display panel 10 comprises a data display area AA in which an input image is displayed and a data non-display area NA outside the data display area AA. High-potential power supply lines VDL are connected to the power supply part to transmit a high-potential power supply voltage to the pixels arranged in the data display area AA. To this end, the high-potential power supply lines VDL run across the data display area AA.

A shorting bar SB may be formed in the data non-display area NA. The shorting bar SB interconnects the high-potential power supply lines VDL. The shorting bar SB may connect the high-potential power supply lines VDL together to reduce wiring resistance. By providing the shorting bar SB, the present invention allows for uniform distribution of the high-potential power supply voltage EVDD over the entire pixel array on the display panel 10.

The high-potential power supply lines VDL running across the data display area AA are connected to the second anode ANO2 of the lighting part ILP. The second anode ANO2 of the lighting part ILP receives the high-potential power supply voltage from the power supply part. An organic compound layer and a cathode are sequentially stacked on the second anode ANO2 to constitute a second OLED.

The second anode ANO2 of the lighting part ILP1 may be formed between the data display area AA and the shorting bar SB, within the shorting bar SB. The lighting part ILP1 may be implemented with the structure described in the first or second exemplary embodiment.

The second anode ANO2 of the lighting part ILP2 may be formed outside the shorting bar SB. The lighting part ILP2 may be implemented with the structure described in the first or second exemplary embodiment. Although not shown, in order for the lighting part ILP2 to be implemented with the structure described in the first exemplary embodiment, the high-potential power supply lines VDL need to be extended further and electrically connected to the second anode ANO2 of the lighting part ILP2.

The second anode ANO2 of the lighting part ILP1 and ILP2 may be formed both within and outside the shorting bar SB. The lighting part ILP1 and ILP2 may be implemented with the structure described in the first or second exemplary embodiment. The lighting part ILP1 within the shorting bar SB may be implemented with the structure described in any one of the first and second exemplary embodiments, and the lighting part ILP2 outside the shorting bar SB may be implemented with the structure described in the other exemplary embodiment.

Referring to FIG. 7, the second anode ANO2 of the lighting part ILP may be placed on at least one of the upper, lower, left, and right sides of the display panel 10, outside the data display area AA. The second anodes ANO2 of the lighting part ILP may have various planar shapes. At least one of the second anodes ANO2 of the lighting part ILP may have a different shape than at least the other one. At least one of the second anodes ANO2 of the lighting part ILP may have a different length or width than at least the other one.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel having a data display area in which pixels are arranged and a lighting part outside the data display area, the pixels comprising organic light-emitting diodes and receiving a high-potential power supply voltage and a low-potential power supply voltage, and the lighting part comprising one or more organic light-emitting diodes;

a display panel driver configured to drive the organic light-emitting diodes in the pixels;

a lighting driver configured to drive the organic light-emitting diodes in the lighting part; and a power supply part configured to generate the high-potential power supply voltage and the low-potential power supply voltage, wherein the display panel comprises:

a plurality of first high-potential power supply lines connected between the power supply part and the pixels;

one or more second high-potential power supply lines connected between the power supply part and the organic light-emitting diodes in the lighting part; and a switch electrically connected to the power supply part and the second high-potential power supply line for switching a current path between the power supply part and the organic light-emitting diodes in the lighting part, wherein the lighting driver is further configured to turn on the switch when there is a user input or when the system power is turned off to supply the high-potential power supply voltage to the organic light-emitting diodes in the lighting part, and wherein each of the pixels and the lighting part selectively emits light.

2. The display device of claim 1, wherein:

a cathode for the organic light-emitting diodes disposed in the pixels and lighting part is shared on the display panel;

an anode for the lighting part is connected to the second high-potential power supply lines; and the pixels are connected to the first high-potential power supply lines.

3. The display device of claim 2, wherein the switch is connected between the first high-potential power supply lines and the second high-potential power supply lines.

4. The display device of claim 3, wherein:

the power supply part comprises an output terminal outputting the high-potential power supply voltage;

one end of the first high-potential power supply lines is connected to the output terminal and the other end of the first high-potential power supply lines is connected to the switch; and one end of the second high-potential power supply lines is connected to the switch and the other end of the second high-potential power supply lines is connected to the anode in the lighting part.

5. The display device of claim 2, wherein:

the first high-potential power supply lines run across the data display area on the display panel and are connected to the pixels; and the second high-potential power supply lines are connected to the anode in the lighting part by bypassing the data display area on the display panel.

6. The display device of claim 5, wherein the switch is disposed on the display panel driver or the display panel.

7. The display device of claim 5, wherein:

the power supply part comprises an output terminal outputting the high-potential power supply voltage; and wherein the first and second high-potential power supply lines are connected to the output terminal through different buffers.

8. The display device of claim 1, wherein the lighting driver is further configured to:

generate a lighting enable signal in response to user input through a user interfaces; and generate a switch control signal for turning on the switch in response to the lighting enable signal.

9. The display device of claim 1, wherein, when the system power is turned off, the lighting part is further configured to:

generate a lighting enable signal and a switch control signal for turning on the switch; and generate an input voltage for the power supply part to allow the power supply part to output the high-potential power supply voltage and the low-potential power supply voltage.

10. The display device of claim 1, wherein:

the display panel further comprises a shorting bar connecting the ends of the second high-potential power supply lines; and the organic light-emitting diodes in the lighting part are provided on at least either within or outside the shorting bar.

11. A display device, comprising:

a display panel having a data display area in which pixels are arranged and a lighting part outside the data display area, the pixels comprising organic light-emitting diodes and receiving a high-potential power supply voltage and a low-potential power supply voltage, and the lighting part comprising one or more organic light-emitting diodes;

a display panel driver configured to drive the organic light-emitting diodes in the pixels;

a lighting driver configured to drive the organic light-emitting diodes in the lighting part; and a power supply part configured to generate the high-potential power supply voltage and the low-potential power supply voltage, wherein the display panel comprises:

a plurality of first high-potential power supply lines connected between the power supply part and the pixels;

one or more second high-potential power supply lines connected between the power supply part and the organic light-emitting diodes in the lighting part; and a switch electrically connected to the power supply part and the second high-potential power supply line for switching a current path between the power supply part and the organic light-emitting diodes in the lighting part, wherein the lighting driver is further configured to turn on the switch when there is a user input or when the system power is turned off to supply the high-potential power supply voltage to the organic light-emitting diodes in the lighting part, wherein the power supply part comprises an output terminal configured to output the high-potential power supply voltage, wherein one end of the first high-potential power supply lines is connected to the output terminal and the other end of the first high-potential power supply lines is connected to the switch, and wherein one end of the second high-potential power supply lines is connected to the switch and the other end of the second high-potential power supply lines is connected to the anode in the lighting part.

* * * * *